US012686546B2

(12) United States Patent
Masters et al.

(10) Patent No.: US 12,686,546 B2
(45) Date of Patent: Jul. 21, 2026

(54) PACKAGING

(71) Applicant: UNITED BISCUITS (UK) LIMITED, London (GB)

(72) Inventors: Matthew John Masters, Ottershaw (GB); Lucian Emil Moise, Oxfordshire (GB)

(73) Assignee: PLADIS (UK) LIMITED, London (GB)

( * ) Notice: Subject to any disclaimer, the term of this patent is extended or adjusted under 35 U.S.C. 154(b) by 303 days.

(21) Appl. No.: 18/706,234

(22) PCT Filed: Oct. 27, 2022

(86) PCT No.: PCT/GB2022/052729

§ 371 (c)(1),
(2) Date: Apr. 30, 2024

(87) PCT Pub. No.: WO2023/079265

PCT Pub. Date: May 11, 2023

(65) Prior Publication Data

US 2026/0159298 A1 Jun. 11, 2026

(30) Foreign Application Priority Data

Nov. 3, 2021 (GB) ..... 2115819

(51) Int. Cl.
*B65D 75/12* (2006.01)
*B65D 75/58* (2006.01)
*B65D 77/20* (2006.01)

(52) U.S. Cl.
CPC ..... *B65D 75/12* (2013.01); *B65D 75/5855* (2013.01); *B65D 77/2096* (2013.01)

(58) Field of Classification Search
CPC .... B65B 9/20; B65D 2575/586; B65D 33/20; B65D 75/12; B65D 75/14; B65D 75/58;
(Continued)

(56) References Cited

U.S. PATENT DOCUMENTS 4,909,017 A 3/1990 McMahon et al.
5,945,145 A * 8/1999 Narsutis ..... B65D 75/5855 383/203

(Continued)

FOREIGN PATENT DOCUMENTS

CN 202575031 U 12/2012
EP 1477425 A1 11/2004

(Continued)

OTHER PUBLICATIONS

SE-423080-B Translation, Spiegelberg H, Apr. 13, 1982 (Year: 1982).*

(Continued)

*Primary Examiner* — Nathan J Newhouse
*Assistant Examiner* — Matthew T Theis
(74) *Attorney, Agent, or Firm* — Dinsmore & Shohl LLP

(57) ABSTRACT

Packaging (1001) for food items, a packaged food product, and methods for packaging food items are disclosed. Such packaging has a sealed cavity (1009) for containing food items, and comprises a continuous sheet of packaging material that wraps around and defines the cavity and which is sealed at the ends of the cavity by end seals (1005*a*, 1005*b*) and along the cavity by a longitudinal fin seal (1006). The first and second end seals are each permanent seals and the longitudinal fin seal is an openable and recloseable seal. A packaged food product comprises food items packaged in such packaging. A method for packaging food items comprises placing food items to be wrapped on a sheet of packaging material, permanently sealing the ends the sheet to itself to form end seals and forming an openable and recloseable longitudinal fin seal.

20 Claims, 6 Drawing Sheets

(58) Field of Classification Search
CPC ..... B65D 75/5838; B65D 75/5855; B65D 77/2096; B65D 77/38; B65D 85/36
USPC ..... 383/203
See application file for complete search history.

(56) References Cited

U.S. PATENT DOCUMENTS

| | | | | |
|---|---|---|---|---|
| 6,318,894 | B1 | 11/2001 | Derenthal | |
| 6,502,986 | B1 | 1/2003 | Bensur et al. | |
| 8,814,430 | B2 * | 8/2014 | Veternik | B23K 26/38 383/203 |
| 10,759,582 | B2 | 9/2020 | Down | |
| 2005/0194284 | A1 | 9/2005 | Vijay | |
| 2006/0257599 | A1 | 11/2006 | Exner et al. | |
| 2008/0152850 | A1 | 6/2008 | Paterson | |
| 2011/0006063 | A1 | 1/2011 | Dunn-Rankin | |
| 2011/0127319 | A1 | 6/2011 | Golden | |
| 2011/0266180 | A1 | 11/2011 | Wipf et al. | |
| 2012/0082764 | A1 | 4/2012 | Paterson | |
| 2012/0091132 | A1 | 4/2012 | Obolenski | |
| 2012/0128835 | A1 | 5/2012 | Lyzenga et al. | |
| 2015/0016756 | A1 | 1/2015 | Down et al. | |
| 2017/0203901 | A1 | 7/2017 | Komro et al. | |
| 2021/0101704 | A1 | 4/2021 | Gundelach et al. | |

FOREIGN PATENT DOCUMENTS

| | | | | |
|---|---|---|---|---|
| EP | 1783059 | A1 | 5/2007 | |
| GB | 2349862 | B | 7/1999 | |
| IT | UB20156005 | A1 | 5/2017 | |
| NZ | 516659 | A | 10/2003 | |
| SE | 423080 | B * | 4/1982 | A61L 9/12 |
| WO | 2010084336 | A1 | 7/2010 | |
| WO | WO-2014067673 | A1 * | 5/2014 | B65D 75/14 |
| WO | 2016003688 | A2 | 1/2016 | |

OTHER PUBLICATIONS

International Search Report and Written Opinion issued Aug. 2, 2023 in related International Application No. PCT/GB2022/052729 filed Oct. 27, 2022.

UKIPO Search Report issued Apr. 4, 2022 in related International Application No. GB2115819.1 filed Nov. 11, 2021.

* cited by examiner

PACKAGING

CROSS-REFERENCE TO RELATED APPLICATIONS

This application is a national stage application under 35 U.S.C. § 371 of International Application No. PCT/GB2022/052729, filed Oct. 27, 2022, which claims the benefit of priority to United Kingdom Patent Application No. 2115819.1, filed Nov. 3, 2021.

FIELD OF THE INVENTION

The present invention concerns packaging. More particularly, but not exclusively, this invention concerns re-sealable packaging having a cavity for containing a plurality of food items. The packaging may include a combination of permanent and re-sealable/re-closeable seals. For example, the packaging may comprise a continuous sheet of packaging material that wraps around and defines a cavity, and which is sealed at a first end of the cavity by a first end seal, at a second opposed end of the cavity by a second end seal, and along the cavity by a longitudinal fin seal that extends from the first end seal to the second end seal, wherein the first and second end seals are each permanent seals and the longitudinal fin seal is an openable and re-closable seal. The invention also concerns a method of packaging a plurality of food items, and packaged food items.

BACKGROUND OF THE INVENTION

Various forms of packaging have been utilised to contain, protect and maintain the freshness of food products. Packaging films are widely used to provide low cost, light-weight and durable packaging. Many packaging films are made from plastics materials, and/or may be mono-layer or multi-layer (also known as laminate) films. Typically, a film is wrapped around one or more food products, and joined to itself, e.g. by welding or with adhesives. In a flow-wrap packaging (also known as horizontal bagging) system, products are placed on a sheet of film which is wrapped around the product(s), and the film is closed at each end by end seals and along the length of the packaging between the ends by a fin seal or a lap seal. Fin seals are also known as A-A seals, or inside-inside seals, because the inside face of one edge of the film joins to the inside face of the opposed second edge. Lap seals are also known as A-B seals, or inside, outside seals, because the inside face of one edge of the film joins to the outside face of the opposed second edge. In vertical bagging systems, a bag is formed from a sheet of film similar to the package formed by a flow-wrapping system, except that one end of the packaging is left open (i.e. only one end seal is formed). The open-ended bag may then be oriented vertically with the open end uppermost, product(s) inserted into the bag, and the open end closed by an end seal.

Traditionally, such film-based packaging has been arranged to be torn open by the user. Some films are provided by points of weakness and/or slits to make the film readily tearable, and some are provided with reinforcing strips to help guide tear formation. Such tear-open packaging, while relatively inexpensive and straightforward to manufacture and use to wrap food items, does not allow the package to be re-sealed. Unless a consumer wishes to consume the entire contents of a pack upon opening, they are often left to choose between either finding a new container for the product, or allowing food items to spoil and/or spill out of the torn packaging.

Cold-seal horizontal form-fill-seal flow wrap packaging is described in UK Patent No. GB2349862B (Dairy Crest Ltd.), incorporated herein by reference.

Various types of re-sealable packaging have been devised. European Patent Application Publication No, EP477425A1 (Amcor Flexibles Europe A/S) discloses tearable resalable packaging utilising cold seal adhesives. While the tear location is said to be better controlled than previously known packs, it appears that care is still required to ensure correct usage. U.S. Pat. No. 5,945,145A (Kraft General Foods), incorporated herein by reference, discloses recloseable packaging for sliced food products—the packaging comprises a flap, which may be pre-cut or defined by end seals having permanent and resealable sections. The flap and seal arrangement is relatively complex and requires specialist film manufacturing and/or packaging equipment. The flap is openable at its end and sides to facilitate removal of slices without undue distortion. International (PCT) Publication No. WO2014067673A1 (Amcor), incorporated herein by reference, discloses a recloseable flow pack for a single, tablet-shaped food product. All seals on pack are openable and recloseable, allowing the packaging film to be fully peeled back and opened to access the tablet inside. It is disclosed that a particular adhesive pattern aids reseal. The pack is suited to tablet products that can be conveniently held in place during opening and reclosing of the packaging. A similar packaging system for a tablet food product is disclosed in US Patent Application Publication No. US2011/0266180A1 (Robert Bosch), incorporated herein by reference.

Some recloseable packaging utilises multi-layer laminate films having an internal adhesive layer. For example, US Patent Application Publication No. US2012082764A1 (Kraft Foods Global Brands), incorporated herein by reference, discloses a film structure with an internal pressure sensitive adhesive layer. Outer layers are heat sealed together to form a lap seal, and when packaging is opened the film delaminates to expose the internal adhesive layer. Such laminates are comparatively expensive to produce, and there is often a requirement for the packaging film to be provided with cuts/predefined points of weakness to control delamination, adding to the complexity of manufacture and use.

It is common for consumers to wish to share food items, especially baked items such as biscuits or cookies. Consumers have a better experience when they are able to choose which item to take from a package, rather than only being able to access the uppermost item in a packet.

There remains a need for recloseable packaging that is cost effective to manufacture and use, and which allow convenient sharing of packaged food items. The present invention seeks to mitigate the above-mentioned problems. Alternatively or additionally, the present invention seeks to provide improved packaging for food items, such as confectionery items, especially baked items such as biscuits and cookies.

SUMMARY OF THE INVENTION

The present invention provides, according to a first aspect, packaging for a plurality of food items, the packaging having a sealed cavity for containing the plurality of food items and comprising a continuous sheet of packaging material that wraps around and defines the cavity and which is sealed at a first end of the cavity by a first end seal, at a second opposed end of the cavity by a second end seal, and along the cavity by a longitudinal fin seal that extends from the first end seal to the second end seal. The first and second end seals are each permanent seals and the longitudinal fin seal is an openable and recloseable seal. An openable and recloseable seal allows the packaging to be opened to access the cavity without damaging the packaging film, and allows the packaging to be reclosed by the consumer to seal the cavity after opening without requiring specialist equipment or any additional materials. For example, and openable and recloseable seal can be opened and reclosed by hand. Thus, it will be understood that an openable and recloseable seal is a resealable seal. Resealing the packaging to reclose the cavity allows the consumer to preserve food item freshness without needing to transfer the items to a separate container (e.g. a biscuit tin). It has been found that such packaging, having permanently closed end seals and an openable/recloseable seal along its length provides particularly cost-effective and convenient to use packaging. For the consumer, the packaging is convenient because the openable/recloseable seal is readily accessible, extending along the length of the packaging, and the permanently sealed ends act as stoppers to help control opening of the pack—the consumer does not accidentally open the packaging so wide that the contents fall out. Yet further, the positioning of the openable and permanent seals causes the packaging to take a boat-shaped form when open, giving the pack a stable shape that is convenient to pass between consumers. Yet further, it has been found that the packaging can be produced from low-cost, convenient to manufacture packaging sheets converted on conventional packaging machinery with little modification. More particularly, there is no requirement for specialised cutting or shaping of packaging materials. Furthermore, the packaging of the present invention may be assembled using conventional machinery. Taking for example a conventional flow-wrap assembly line—permanently sealed end seals and permanently sealed fin seals are often formed by pressing layers of film together between heated rollers. End seals of the packaging of the present invention may, for example, be formed in the same manner, while the longitudinal fin seal may be formed by pressing together layers of film having a pressure sensitive adhesive disposed between them. In that case, it may be that the only machinery modification required is to disable the heating for the fin seal rollers. The packaging of the present invention is also advantageous because fin seals are especially convenient and efficient to produce—in contrast to lap seal formation, adhesives for forming a fin seal are applied on the same side of a web or sheet or material, allowing all adhesive to be printed in a single pass through printing equipment.

It will be understood that the continuous sheet of packaging material is a single sheet of material, for example having first and second opposed side edges and first and second opposed end edges. The sheet may have an inner surface (i.e. arranged to face the cavity/the interior of the packaging) and an opposed outer surface. It will be understood that a longitudinal fin seal is an A-A seal, for example wherein the sheet of packaging material is arranged with the inner surface of a first side edge abutting the inner surface of a second side edge along the longitudinal seal. Similarly, it will be understood that each end seal is an A-A seal, for example wherein the sheet of packaging material is arranged with the inner surface of each end edge folded onto itself. Optionally, the sheet has a plurality of sealing portions that seal together at the end and longitudinal fin seals to close the cavity. For example, the sheet may have a first side edge portion that abuts and joins a second side edge portion along the longitudinal fin seal, and/or a first and second end edge portions that each fold over and joins to itself along the first and second end seals, respectively. Additionally or alternatively, the sheet may have a first side sealing portion at or adjacent a first side edge that seals to a second side sealing portion at or adjacent a second side edge. Optionally, the longitudinal fin seal and the end seals each join a portion of the inner surface of the sheet to another portion of the inner surface of the sheet. It will be understood that a sealing portion may, for example, be a portion of the sheet designated for permanent (welded) sealing (such as a portion of the end designated for heat sealing) or a portion coated with an adhesive (such as a portion of the side coated with a cold-seal adhesive).

It will be appreciated that the terms 'permanent seal' and 'openable/recloseable seal' are familiar in the art. For example, it will be understood that a permanent seal does not allow a sealed join to be opened without damaging the packaging material and/or which cannot be resealed once opened by a consumer. In contrast, openable seals/recloseable seals will be understood to refer to sealed joins that can be opened by a consumer to access the interior of the packaging and subsequently reclosed by the consumer to reseal the packaging. Preferably, the permanent seals are welded seals. Optionally, the packaging is plastic film packaging, which may for example be subjected to thermal welding by application of pressure and heat or ultrasonic welding by exposure to pressure and high frequency vibrational energy. Typically, openable/recloseable seals used in packaging materials utilise cold-seal adhesives (e.g. pressure-sensitive adhesives). As used herein, and unless stated otherwise, the terms 'inner' and 'outer' are relative to the cavity.

Preferably, the packaging is form-fill-seal packaging. Typically, in form-fill-seal packaging, a wrapper is first formed into a shape such as a cylinder or bag, then filled with one or more food products, and then sealed to form the packaged food item. Examples of form-fill-seal packaging include horizontal form-fill-seal packaging (sometimes referred to as flow-wrap packaging) and vertical form-fill-seal packaging (sometimes referred to as vertical bagging). The fill methodology used often depends on the nature of the food product. Products that can be stacked or otherwise arranged in a block (such as biscuits) tend to be more suited to horizontal form-fill-seal packaging because they can be pushed into the packaging as a block. Products that are more disordered (such as small snacks) tend to be more suited to vertical form-fill-seal packaging because they can be poured into the packaging from above.

Optionally, the sheet is folded twice at each end seal, for example so that the sheet folds back upon itself along each end seal and so that the opposed sides of the sheet meet at the longitudinal fin.

Optionally, the sheet of packaging material comprises a polymeric material, for example wherein the sheet is a plastic film. Optionally the sheet is a recyclable material and/or comprises recycled material. Examples of suitable materials include polyolefins, such as polypropylene, and polyesters. It will be appreciated that the film may be a multi-layer (e.g. laminate) film, or a monolayer film, optionally a monolayer film. Optionally, the film comprises OPP (oriented polypropylene, e.g. biaxally oriented polypropylene, BOPP) film and/or PET (polyethylene terephthalate film, also known as a polyester film, e.g. oriented polyester film, such as biaxally oriented polyester film), preferably OPP. Optionally, the film is a monolayer OPP or PET, preferably OPP, film. Optionally, the film is a bilayer OPP/OPP film, OPP/PET film, or PET/PET film, such as bilayer OPP/OPP film or OPP/PET film, for example bilayer OPP/OPP film. Optionally, at least one layer, such as the inner layer, of the film has a heat-sealable surface on the inner face of the film. It will be understood that a heat-sealable surface is, for example, a surface weldable to itself when portions of the film are pressed together between heated jaws or rollers. Optionally, the film a thickness of at least 20 microns, such as at least 40 microns, for example 20-60 microns, e.g. 30-50 microns. Optionally, the film is a monolayer film, such as an OPP monolayer film, having a thickness of at least 20 microns, such as at least 40 microns, for example 20-60 microns, e.g. 30-50 microns. Optionally, the film has at least two layers (such as at least two OPP layers and/or at least an OPP layer and a PET layer, preferably at least two OPP layers), for example the film is a bilayer film, wherein each layer has a thickness of at least 10 microns, preferably wherein the two layers have a combined thickness of at least 20 microns, such as a combined thickness of at least 30 microns, for example wherein the two layers have a combined thickness of 20-60 microns, e.g. 30-50 microns. Optionally, each layer of the film has the same or different thicknesses. Preferably, the film has an oxygen transmission rate (23° C.-0% R.H.) of no more than 2000 cc/m$^2$ d atm (measured according to ASTM D3985) and/or a water vapour transmission rate (38° C.-100% R.H.) or no more than 8 g/m$^2$ d) (measured according to ASTM F1249). Examples of suitable OPP and PET films include those available from Vibac®, Polibak® (e.g. PL1, PWE), Jindal Films® (e.g. Bicor™), Innovia (e.g. Propafilm™), Super Film Packaging Films®, and Polinas® (e.g. Polipet®).

Optionally, the cavity is sealed to reduce water vapour and/or oxygen transmission between the cavity and the surroundings of the packaging. It will be appreciated that the tightness of the seal will vary according to the nature of the products contained in the packaging.

Optionally, the end seals and the longitudinal fin seal are the only seals that close the cavity. Additionally or alternatively, the packaging consists of the sheet of material and optionally one or more adhesives forming the longitudinal fin seal that closes the cavity. Optionally, the end seals are free from any adhesive, such as a pressure sensitive adhesive.

Preferably, the first and second end seals are heat-sealed. Optionally, each end is welded (for example by thermal or ultrasonic welding). For example, at each end seal the end edge of the sheet is welded to itself (e.g. the inner surface of the first end edge to another part of the inner surface of the first end edge, and the inner surface of the second end edge to another part of the inner surface of the second end edge). Optionally the end seals are positioned at the outer end edges of the sheet of packaging material, for example so that end tips of the sheet are sealed closed. Optionally, the end edges of the sheet are straight-cut. It will be appreciated that straight-cut ends form a straight linear edge, as opposed to serrated-cut ends which may have a zig-zag shaped or jagged edge. It may be that a straight cut edge helps to avoid damage to, or accidental misuse of, the packaging. For example, serrated cut edges can make packaging film more susceptible to tearing, for example during handling, and/or can encourage consumers to tear the packaging open at the ends rather than use the openable/recloseable fin seal. Optionally, the side edges of the sheet are straight-cut. It will be appreciated that straight-cut sides form a straight linear sedge, as opposed to other side shape profiles which may, for example, require more complex sheet cutting methods.

Optionally, the longitudinal fin seal is cold-sealed. Typically, a cold seal adhesive is a material that has good adhesion to itself at ambient temperatures, a property that is often referred to as "self-adhesion", "auto adhesion", or "autohesion". Optionally, the cold seal adhesive is a natural rubber latex adhesive, or a natural rubber latex-free adhesive. Preferably, the cold seal adhesive is applied to both surfaces that are to be sealed together. Optionally, the longitudinal fin seal comprises a cold-seal adhesive that adheres the first side edge of the sheet to the second side edge of the sheet (e.g. the inner surface of the first side edge to the inner surface of the second side edge). Preferably, the cold-seal adhesive is a pressure sensitive adhesive. Suitable cold seal adhesives include those available from Valpac® (e.g. CH260 series adhesives), Dyna-Tech Adhesives® (e.g. CoStick®), Dow® (e.g. COSEAL™ adhesives) and van Asperen Fleestoffen B.V.® (e.g. Liofol® adhesives). It will be appreciated that adhesives may, for example, be chosen depending on the seal strength and resealability (e.g. number of reseals) desired.

Optionally, the packaging comprises an opening tab element adjacent the longitudinal fin seal, for example a tab element arranged to be gripped by the user to aid opening of the fin seal. Preferably, the tab element is a part of the sheet of packaging material. For example, the tab element is part of one of the side edges of the sheet. Optionally, the packaging comprises a plurality of tab elements, for example a first tab element formed by the sheet at or along the first side edge and a second tab element formed by the sheet at or along the second side edge. Additionally or alternatively, a plurality of tab elements are formed by the sheet at or along one side edge. It will be appreciated that the tab elements may, for example, be formed by positioning the sheet edges so that the side edges are offset. It will be understood that when the side edges are offset, the first side edge may protrude beyond the second side edge, or vice versa, along the longitudinal fin. Optionally, the or each tab element comprises a portion of the inner surface of the sheet, for example configured to be gripped by a consumer. Optionally, the or each tab element comprises a portion of the inner surface of the sheet having a surface area of at least 1 cm$^2$ (100 mm$^2$), for example at least 2 cm$^2$ (200 mm$^2$). Optionally, the or each tab element is free from adhesive, for example the or each tab element comprises a portion of the inner surface of the sheet free from adhesive. For example, it may be that the or each tab element is a part of the sheet positioned outwards of a side sealing zone, optionally wherein the side sealing zone is spaced apart from one or both side edges of the sheet, optionally wherein the sheet has straight-cut side edges.

Optionally, the longitudinal fin comprises an adhesive (e.g. a cold-seal adhesive such as a pressure-sensitive adhesive) arranged along the fin at or adjacent to the side edges of the sheet. Optionally, the longitudinal fin seal comprises a sealing zone extending along the length of the packaging from the first end seal to the second end seal, for example being the area of the fin where a first side sealing portion of the sheet contacts a second side sealing portion, for example to form a continuous seal along the length of the longitudinal fin between the end seals. Preferably, the end seal zones are substantially free from, for example entirely free from, adhesive, such as pressure sensitive adhesive. Accordingly, the fin seal may have a first end portion at the first end of the packaging closed by the first permanent end seal and a second end portion at the second end of the packaging closed by the second permanent end seal. Optionally, the adhesive covers and/or defines a sealing zone. Optionally, the longitudinal fin comprises a sealing zone spaced apart from the first side edge by a first distance (optionally along at least 25%, such as the whole, length of the first edge), and/or spaced apart from the second side edge by a second distance (optionally along at least 25%, such as the whole, length of the second edge), for example wherein the first distance is the same as or different from the second distance. Additionally or alternatively, the sealing zone is spaced apart from the first side edge and is positioned at the second side edge, or vice versa. Optionally, the first distance is in the range of about 0.3 cm (3 mm) to about 2.0 cm (20 mm), such as about 0.5 cm (5 mm) to about 1.0 cm (10 mm). Optionally, the second distance is in the range of about 0.3 cm (3 mm) to about 2.0 cm (20 mm), such as about 0.5 cm (5 mm) to about 1.0 cm (10 mm). It will be appreciated that when the sealing zone is spaced apart from an edge, said edge may provide an area of the sheet that extends outwards from the fin seal and which can be gripped by a consumer to aid opening of the packaging. Optionally, the longitudinal fin comprises a plurality of sealing zones, such as a first sealing zone spaced apart from a second sealing zone, for example wherein a first sealing zone is positioned at or adjacent the side edges of the sheet and a second sealing zone is positioned adjacent the cavity. Optionally, the longitudinal fin comprises a sealing zone shaped to define one or more tab elements, optionally wherein the first and second side edges of the sheet have matching and optionally aligned edge profiles. For example, the sealing zone has an outer edge profile having a different shape to that of the first and/or second side edge of the sheet. It will be understood that the outer edge of the sealing zone is the distal edge relative to the cavity. Optionally, the outer edge profile of the sealing zone is shaped to provide at least one, such as a plurality of, for example at least three, tab element areas along the longitudinal fin that are free from adhesive. Preferably, the or each tab element area extends about 0.3 cm (3 mm) to about 2.0 cm (20 mm), such as about 0.5 cm (5 mm) to about 1.0 cm (10 mm), from the outer edges of the sheet towards the cavity. It will be appreciated that each tab element area may have any suitable shape, such as an angled (e.g. square or triangular) or curved shape. It will be understood that the shape of a tab element corresponds to the shape of the sealing zone edge profile that bounds the tab area.

The present invention provides, according to a second aspect, a wrapped food product, the product comprising a plurality of food items packaged in packaging according to the first aspect of the invention. Optionally, the food items are confectionery items, such as baked confectionery items, for example biscuits and/or cookies. Preferably, the cavity of the packaging is free from any container, such as a tray, for holding the food items. For example, the cavity contains only the food items, such as wherein the wrapped food product consists of the packaging and the food items. Optionally, the wrapped food product comprises at least 10 food products, such as at least 20 food products. Optionally, the food products are stacked in the packaging. Optionally, the food products are stacked in the packaging, wherein a first food item is positioned at the first end of the packaging, a second food item is positioned at the second end of the packaging, and a plurality of additional food items are positioned in a row between the first and second food items. It will be appreciated that arranging the food items in a row adjacent the longitudinal fin seal allows all food items to be conveniently accessed when the pack is opened along the fin seal. Alternatively, the food items are stacked in the packaging in a so-called 'penny stack' arrangement. Optionally, the food products are stacked in the packaging, wherein a first plurality of items are stacked at the first end of the packaging in a first stack, and a second plurality of items are stacked at the second end of the packaging in a second stack parallel to the first stack. Optionally, further parallel stacks are arranged in a row between the first and second stacks. Optionally, a further row of parallel stacks is arranged alongside said row. It will be appreciated that items may, for example, be stacked towards the fin seal, or across the fin seal. For example, when a stack is arranged towards the fin seal, it may be that only the top-most item of each stack is accessible when the fin seal is opened. Alternatively, when a stack is arranged across the fin seal, it may be that multiple items in the stack (e.g. all items in the stack) are accessible when the fin seal is opened.

The present invention provides, according to a third aspect, a method of packaging a plurality of food items, the method comprising the steps of: placing food items to be wrapped on a sheet of packaging material, folding the packaging material so that a surface of the sheet forms an inner surface and an opposed surface of the sheet forms an outer surface of the packaging, permanently sealing a first end of the sheet to itself to form a first end seal, permanently sealing a second end of the sheet to itself to form a second end seal, and forming a longitudinal fin seal along the packaging from the first end to the second end thereby joining a first side edge of the sheet to a second side edge of the sheet and defining a cavity containing the food items, wherein the longitudinal fin seal is an openable and recloseable seal. Optionally, the method provides a packaged food product according to the second aspect of the invention. It will be appreciated that the steps may optionally be carried out in a different order to that set out above. For example, the longitudinal fin seal may be formed before, after or simultaneously with the first and/or second end seal. Similarly, the first end seal may optionally be formed before, after or simultaneously with the second end seal. Furthermore, the food items may optionally be placed on the sheet of packaging material at any stage in the process, provided that they are placed on the sheet before the final seal is formed. For example, one or more seals may optionally be formed before the food items are placed on the sheet.

Optionally, the first and/or second end seal is welded (e.g. thermally or ultrasonically welded). Optionally, the portions of the sheet joined together to form each of the first and/or second end seals are pressed together between jaws or rollers, such as heated jaws or rollers. For example, a heat-sealed welded join may for example be achieved by use of sealing jaws or rollers that apply heat and pressure, thereby melting an inner surface (or layer) of the film permanently welding films together. Optionally, the longitudinal fin seal is cold sealed (e.g. using a cold seal adhesive). Optionally, the portions of the sheet joined together to form the longitudinal fin seal are pressed together between jaws or rollers, such as unheated jaws or rollers. Optionally, the fin seal is formed by pressing side seal portions of the sheet together between unheated rollers, and the end seals are formed by pressing end seal portions together between heated jaws. Optionally, each sheet of packing material is cut from a continuous web of packaging material, for example before, during or after forming the packaged food product.

The present invention provides, according to a fourth aspect, a sheet of packaging material configured to form the packaging of the first aspect of the invention. Optionally, the sheet of packaging material has an inner surface and an opposed outer surface, first and second opposed ends and first and second opposed sides. Optionally, the sheet comprises first and second end seal portions on the inner surface at the first and second ends, respectively, and first and second side seal portions on the inner surface at or adjacent to the first and second sides, respectively. Optionally, the first and second end seal portions are designated heat-seal, e.g. configured to be welded when pressed together between heated jaws or rollers. Preferably, the first and second end seal portions are free from cold-seal adhesive. Optionally, the first and second side seal portions are each coated with a cold sealing adhesive. It will be understood that the sheet is configured so that it can be folded to form various configurations, for example with end seals formed by each end seal portion sealing to itself, and a longitudinal fin seal formed by bringing together the side seal portions. It will be appreciated that the sheet may be part of a web of packaging material.

It will of course be appreciated that features described in relation to one aspect of the present invention may be incorporated into other aspects of the present invention. For example, the method of the invention may incorporate any of the features described with reference to the packaging of the invention and vice versa.

DESCRIPTION OF THE DRAWINGS

Embodiments of the present invention will now be described by way of example only with reference to the accompanying schematic drawings of which.

DETAILED DESCRIPTION

Figure 1:
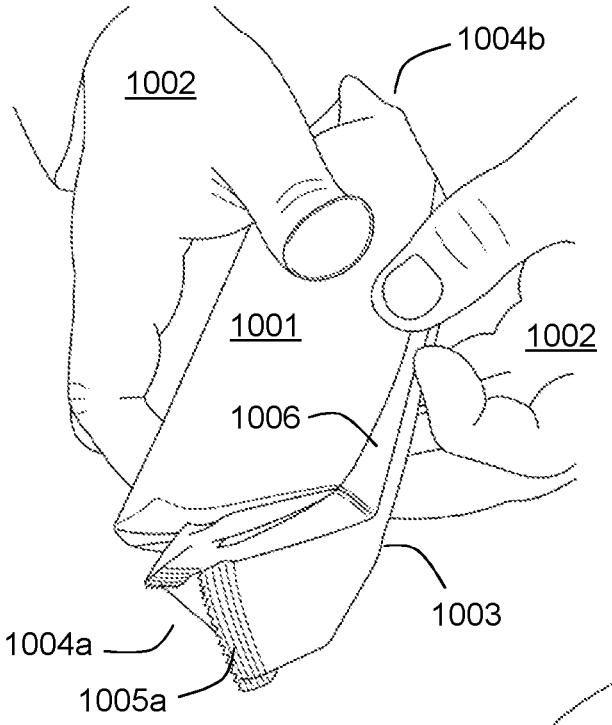
FIG. 1 shows a perspective view of packaging according to a first embodiment of the invention prior to opening.

FIG. 1 shows a perspective view of packaging according to a first embodiment of the invention prior to opening, held by a consumer 1002. The packaging 1001 shown is a pack of biscuits, flow-wrapped in a sheet of plastic film 1003. The packaging has a heat-sealed first end 1004*a* and a heat-sealed second end 1004*b*, providing permanent (welded) end seals (only end seal 1005*a* is shown in FIG. 1). A longitudinal fin seal 1006 extending along the rear of the packaging from the first end 1004*a* to the second end 1004*b* is an openable/recloseable cold-sealed join. The seal is provided by a pressure sensitive adhesive. In this condition, the packaging protects the contents from moisture, sealing the biscuits inside the internal cavity formed by the packaging and thereby extending product shelf life.

Figure 2:
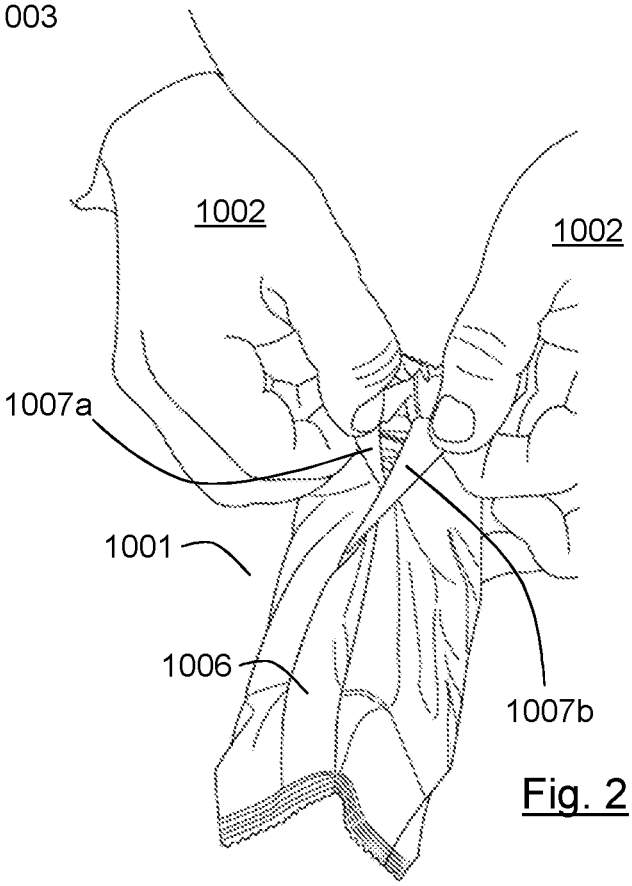
FIG. 2 shows perspective view of the packaging of FIG. 1 during opening of the longitudinal fin seal.

FIG. 2 shows a perspective view of the packaging 1001 of FIG. 1 during opening. To open the fin seal 1006, the consumer grips the opening tabs 1007*a*, 1007*b* of the first and second side edges and pulls them apart. The cold-seal adhesive allows the package to be opened without tearing the sheet of film.

Figure 3:
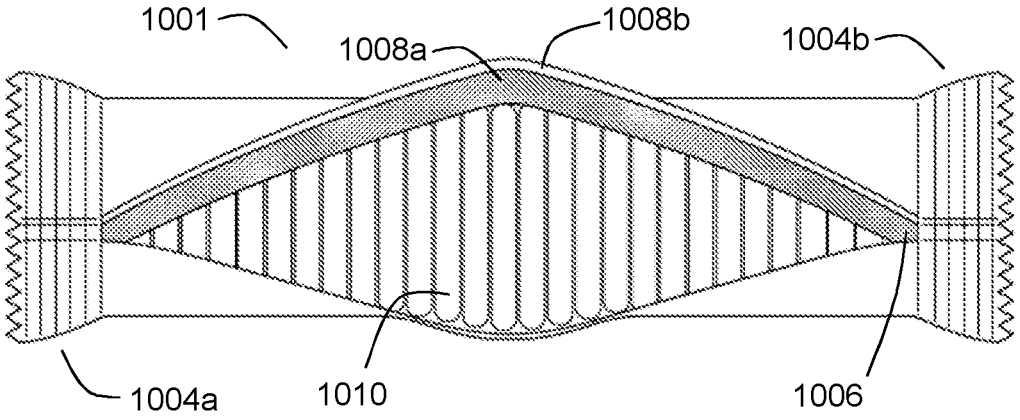
FIG. 3 shows a top plan view of the packaging of FIG. 1 with the longitudinal fin seal open.

FIG. 3 shows a top plan view of the packaging 1001 of FIG. 1 with the longitudinal fin seal 1006 open. The permanently sealed first and second ends 1004*a*, 1004*b* act as stoppers preventing the packaging from being opened excessively, avoiding the problem of the contents spilling out of the packaging when it is opened. Once the fin seal 1006 is opened, the consumer is given a choice of biscuits 1010 to select, rather than for example being presented with only the uppermost biscuit. To reclose the packaging, the user need simply press the sides of the packaging together along the fin 1006. The ends 1004*a*, 1004*b* are shown with zig-zag cut ends, but could be given straight cut ends to help deter consumers from tearing the pack instead of unpeeling the fin seal 1006. The first sealing zone 1008*a* over which pressure sensitive adhesive is applied is spaced inwards from the first side edge of the sheet, providing a first opening tab element 1008*b* free from adhesive, which may be gripped by the user to open the pack. There is a corresponding opening tab element on the second side edge of the sheet, not visible in FIG. 3.

Figure 4:
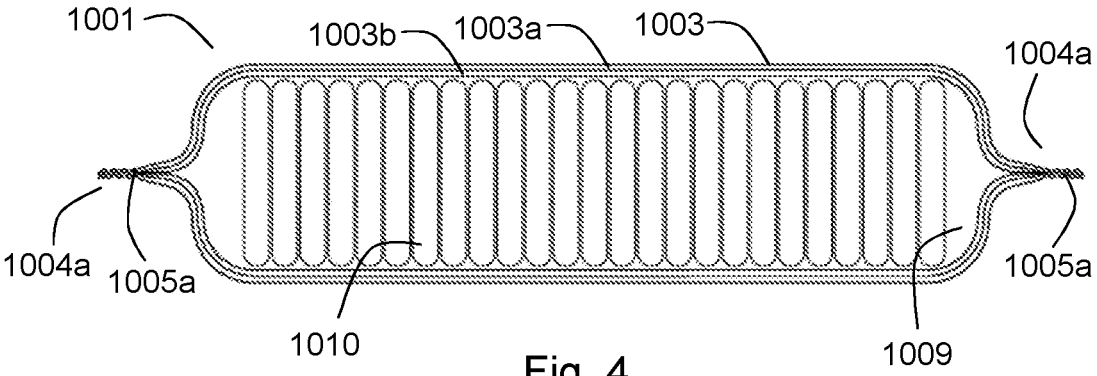
FIG. 4 shows a cross-sectional view of the packaging of FIG. 1 prior to opening, cut along the length of the packaging.

FIG. 4 shows a cross-sectional view of the packaging 1001 of FIG. 1, cut along its length. The film 1003 forming the wrapper is a bilayer film (layer thicknesses are exaggerated in FIG. 4 for the purposes of illustration, the actual thickness of each layer is about 20 microns) having an outer OPP layer 1003 *a* and an inner OPP layer 1003 *b*, the inner surface of the inner layer 1003*b* being heat-sealable. Permanent end seals 1005*a*, 1005*b* are formed at the first and second ends 1004*a*, 1004*b*, respectively, by heating the ends under pressure in heated jaws. The biscuits 1010 contained in the cavity 1009 are shown inside the packaging 1001.

Figure 5:
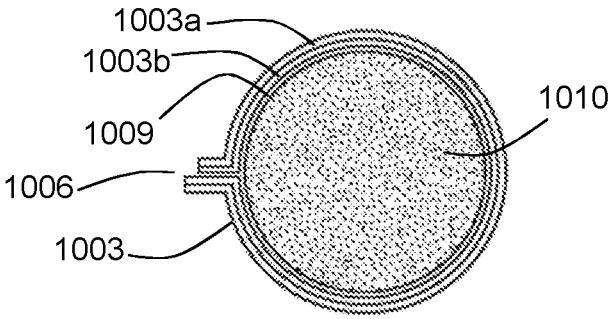
FIG. 5 shows a cross-sectional view of the packaging of FIG. 1 prior to opening, cut across the length of the packaging.

FIG. 5 shows a cross-sectional view of the packaging 1001 of FIG. 1, cut across its length. The cross section is taken through the middle of the pack, showing one of the biscuits 1010 contained in the cavity 1009. At the fin seal 1006, a portion of the inside of the inner layer 1003*b* of the film 1003 is joined to another potion of the inside of the inner layer 1003*b* of the film 1003, providing an A-A seal along the length of the longitudinal fin 1006. The side edges of the sheet are offset along the fin seal so that the first opening tab element is larger than the second opening tab element. That is achieved by spacing the first sealing zone further from the first side edge than the second sealing zone is spaced from the second side edge.

Figure 4A:
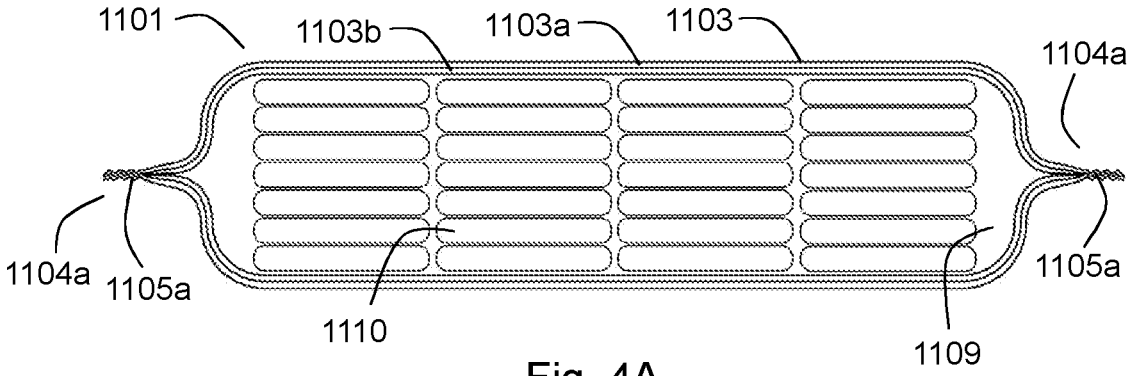
FIG. 4A shows a cross-sectional view of packaging according to a second embodiment of the invention prior to opening, cut along the length of the packaging.

FIG. 4A shows a cross-sectional view of packaging 1101 of a second embodiment of the invention, cut along its length. The packaging is substantially identical to that of the first embodiment, with the only difference being that the biscuits 1110 are 'penny stacked' in four stacks arranged parallel and side by side through the length of the packaging. The same reference numerals are used to identify the parts of the packaging as in FIG. 4, except that the prefix '11' is used rather than '10'.

Figure 5A:
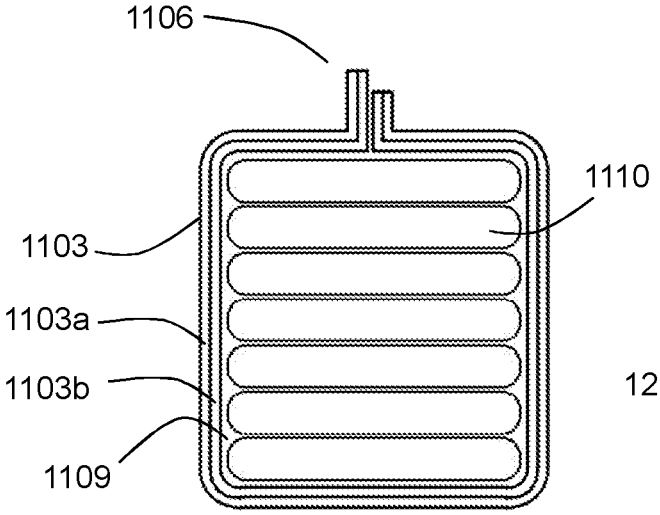
FIG. 5A shows a cross-sectional view of the packaging of FIG. 4A prior to opening, cut across the length of the packaging.

FIG. 5A shows a cross-sectional view of the packaging 1101 of FIG. 4A, cut across its length. The cross section is taken through the middle of the pack, showing one of the stacks of biscuits 1110 contained in the cavity 1109. As shown in FIG. 5A, the biscuits 1110 are stacked towards the fin seal 1106, so that the top-most biscuit of the stack is accessible when the fin seal 1106 is opened. The same reference numerals are used to identify the parts of the packaging as in FIG. 5, except that the prefix '11' is used rather than '10'.

Figure 5B:
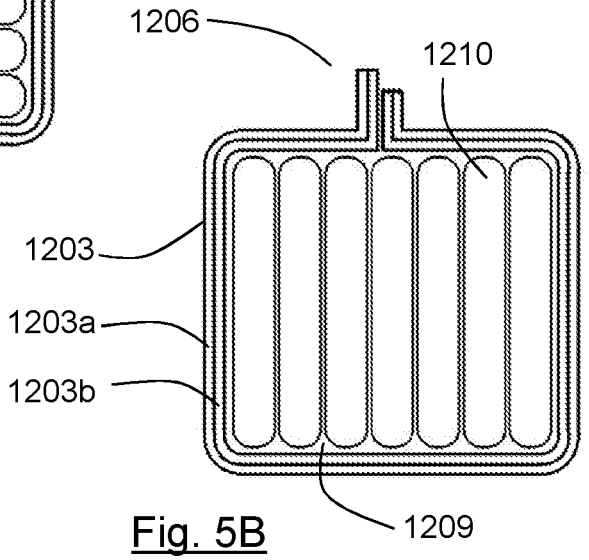
FIG. 5B shows a cross-sectional view of packaging according to a third embodiment of the invention prior to opening, cut across the length of the packaging.

FIG. 5B shows a cross-sectional view of packaging 1201 of a third embodiment of the invention, cut across its length. The packaging is substantially identical to that of the second embodiment, with the only difference being that the penny stacked biscuits 1210 are stacked across the fin seal 1206. As shown in FIG. 5B, the multiple biscuits 1210 of the stack are accessible when the fin seal 1206 is opened. The same reference numerals are used to identify the parts of the packaging as in FIG. 5A, except that the prefix '12' is used rather than '11'.

Figure 6A:
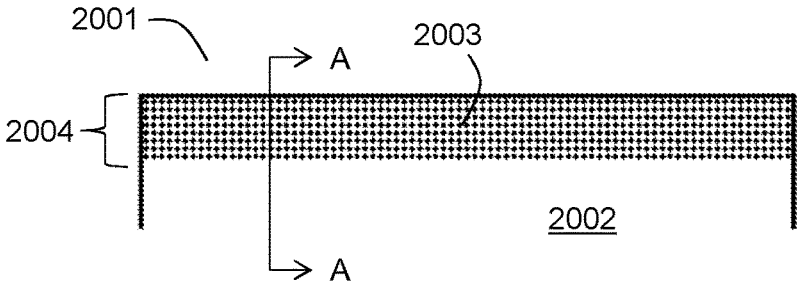
FIGS. 6*a* and 6*b* show side and cross-sectional schematic views of a cold-seal adhesive arrangement in a fin seal suitable for the packaging of the invention.
Figure 6B:
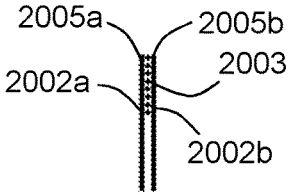

FIG. 6*a* shows a cut-away schematic side view of a longitudinal fin seal 2001 suitable for use in the packaging according to the invention, and FIG. 6*b* shows a schematic cross-sectional view of the fin seal 2001 along A-A. The fin seal 2001 joins a first side 2002*a* of a sheet 2002 to a second side 2002*b* using a pressure sensitive adhesive 2003 (represented by a diamond pattern in FIGS. 6*a* and 6*b*). Only the side parts of the sheet 2002 are shown in the cut-away views of FIGS. 6*a* and 6*b*. The sealing zone 2004 is positioned at the first and second side edges 2005*a*, 2005*b*. In the schematic view of FIG. 6*a*, the sealing zone is shown extending along the whole length of the fin seal 2001—in practice, the ends of the fin seal (i.e. the parts that lie in the end sealing zones) are free from cold-seal adhesive, so that the cold-seal adhesive does not interfere with the permanent (welded) seals.

Figure 7:
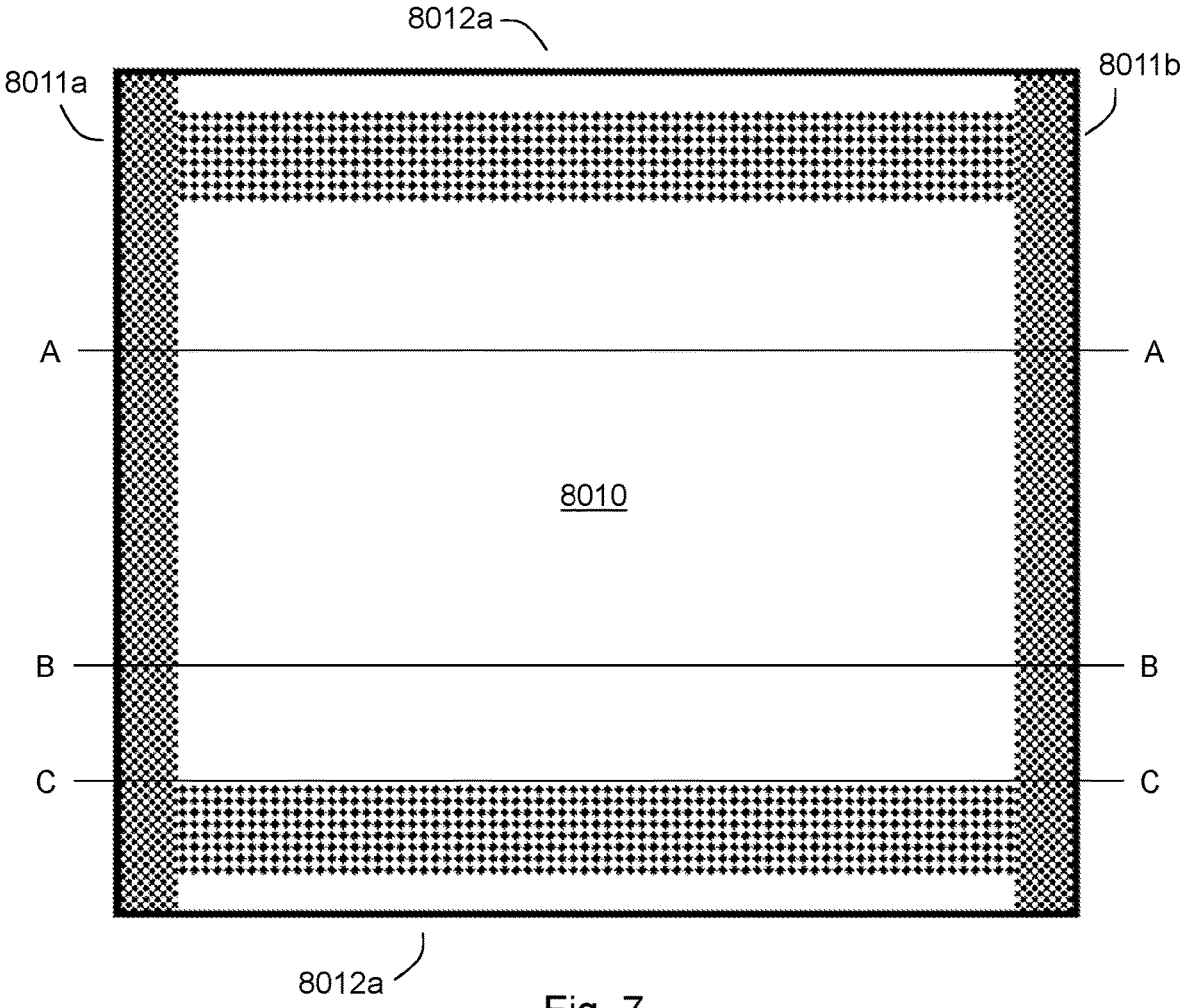
FIG. 7 shows a top plan view of a sheet of packaging material according to the invention; and, FIGS. 8*a* to 11*b* show side and cross-sectional schematic views of various cold-seal adhesive arrangements in fin seals suitable for the packaging of the invention.

FIG. 7 shows a top plan view of a sheet of packaging 8010 according to the invention. Only the inner surface of the sheet 8010 is visible in FIG. 7. The sheet 8010 has first and second opposed ends 8011*a*, 8011*b* and first and second opposed sides 8012*a*, 8012*b*. The comprises first and second end seal zones on the inner surface at the first and second ends, respectively, and first and second side seal portions on the inner surface at or adjacent to the first and second sides, respectively. The first and second end seal portions are each areas designated for heat sealing by welding, and are thus free from cold-seal adhesive, and are marked by a chequerboard pattern in FIG. 7. The first and second side seal portions are each coated with a cold sealing adhesive marked by a diamond pattern in FIG. 7. The sheet is configured so that it can be folded at least twice, firstly along A-A and secondly along line B-B. When folded along lines A-A and B-B, end seals are formed as the first end seal portion seals to itself and the second end seal portion seals to itself. The first and second side seal portions are brought together to seal to each other to form a longitudinal fin seal, which may be folded flat along line C-C. It will be appreciated that other folds may be made to provide packaging of different shapes and sizes.

Figure 8A:
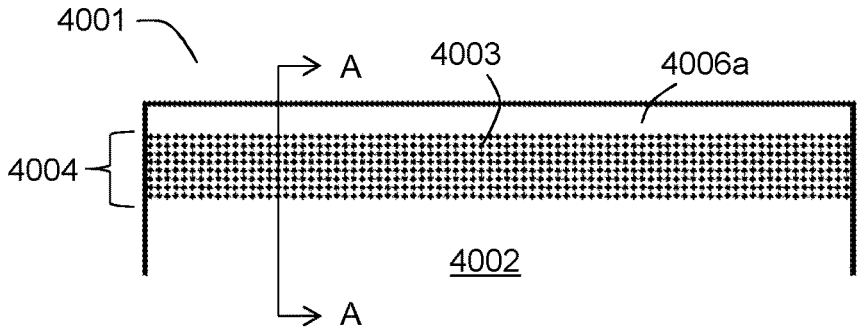
Figure 8B:
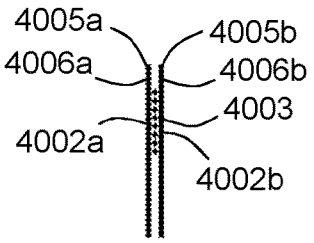

FIG. 8*a* shows a cut-away schematic side view of another longitudinal fin seal 4001 suitable for use in the packaging according to the invention, FIG. 8*b* shows a schematic cross-sectional view of the fin seal 4001 along A-A. Features the same as those of fin seal 2001 in FIGS. 6*a* and 6*b* are labelled with the same reference numerals, except that the prefix '4' is used in place of '2'. The sealing zone 4004 is spaced apart from the first and second side edges 4005*a*, 4005*b* by equal amounts, providing equally sized opening tab elements 4006*a*, 4006*b* free from adhesive along the length of the fin seal 4001.

Figure 9A:
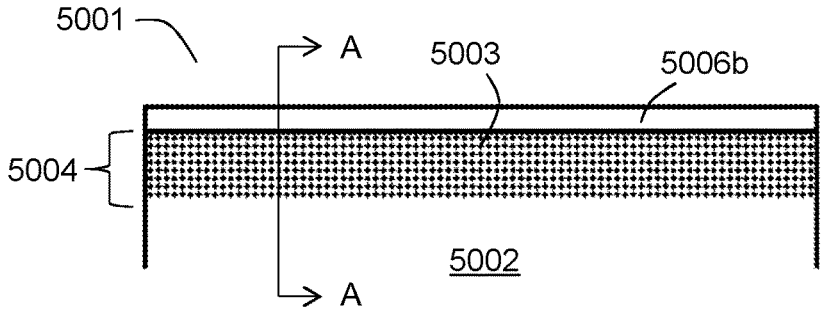
Figure 9B:
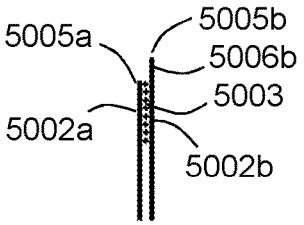

FIG. 9*a* shows a cut-away schematic side view of another longitudinal fin seal 5001 suitable for use in the packaging according to the invention, FIG. 9*b* shows a schematic cross-sectional view of the fin seal 5001 along A-A. Features the same as those of fin seal 2001 in FIGS. 6*a* and 6*b* are labelled with the same reference numerals, except that the prefix '5' is used in place of '2'. The side edges 5005*a*, 5005*b* of the sheet are offset along the fin, with the sealing zone 5004 positioned at the side edge 5005*a* and spaced apart from the side edge 5005*b*, thereby providing an opening tab element 5006*b* free from adhesive along the length of the fin seal 5001.

Figure 10A:
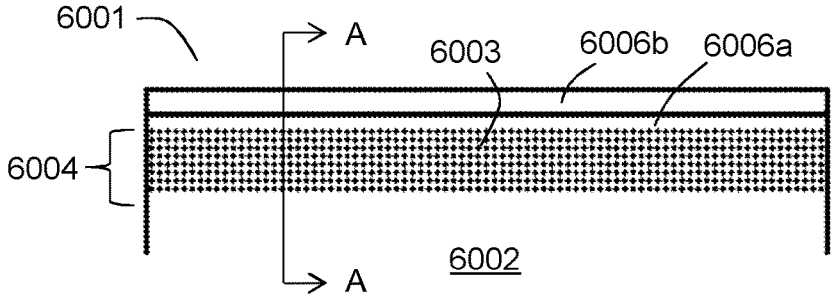
Figure 10B:
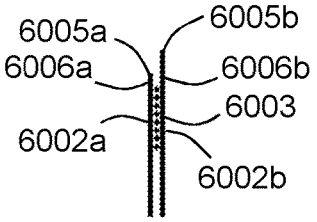

FIG. 10*a* shows a cut-away schematic side view of another longitudinal fin seal 6001 suitable for use in the packaging according to the invention, FIG. 10*b* shows a schematic cross-sectional view of the fin seal 6001 along A-A. Features the same as those of fin seal 2001 in FIGS. 6*a* and 6*b* are labelled with the same reference numerals, except that the prefix '6' is used in place of '2'. The side edges 6005*a*, 6005*b* of the sheet are offset along the fin, with the sealing zone 6004 spaced apart from the side edges 6005*a*, 6005*b* by different amounts, thereby providing differently sized opening tab elements 6006*a*, 6006*b* free from adhesive along the length of the fin seal 6001.

Figure 11A:
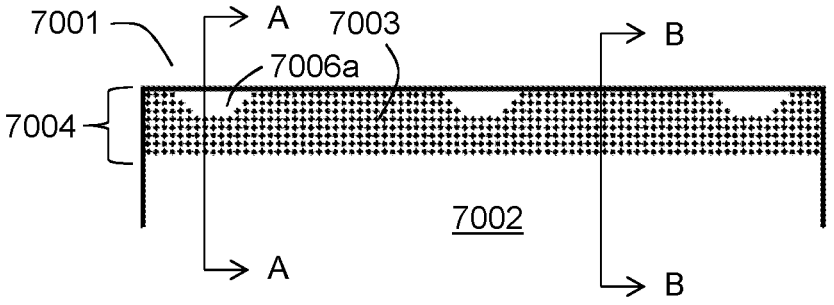
Figure 11B:
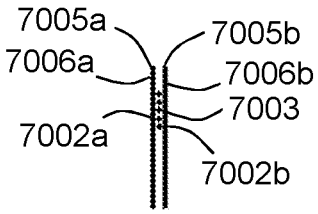

FIG. 11*a* shows a cut-away schematic side view of another longitudinal fin seal 7001 suitable for use in the packaging according to the invention, FIG. 11*b* shows a schematic cross-sectional view of the fin seal 7001 along A-A. It will be appreciated that the cross-sectional view along B-B for fin seal 7001 would be substantially identical to the view of fin seal 2001 shown in FIG. 6*b*. Features the same as those of fin seal 2001 in FIGS. 6*a* and 6*b* are labelled with the same reference numerals, except that the prefix '7' is used in place of '2'. The sealing zone 7004 is positioned at side edges 7005*a*, 7005*b*, however the edge profile shape of the sealing zone 7004 does not match the edge profile of the side edges 7005*a*, 7005*b* so that there are three areas along the side edges 7005*a*, 7005*b* free from adhesive providing opening tab elements on each side of the sheet 7002. Opening tab elements 7006*a*, 7006*b* are visible in the cross-sectional view along A-B shown in FIG. 11*b*.

Whilst the present invention has been described and illustrated with reference to particular embodiments, it will be appreciated by those of ordinary skill in the art that the invention lends itself to many different variations not specifically illustrated herein.

Where in the foregoing description, integers or elements are mentioned which have known, obvious or foreseeable equivalents, then such equivalents are herein incorporated as if individually set forth. Reference should be made to the claims for determining the true scope of the present invention, which should be construed so as to encompass any such equivalents. It will also be appreciated by the reader that integers or features of the invention that are described as preferable, advantageous, convenient or the like are optional and do not limit the scope of the independent claims. Moreover, it is to be understood that such optional integers or features, whilst of possible benefit in some embodiments of the invention, may not be desirable, and may therefore be absent, in other embodiments.

The invention claimed is:

1. A packaged food product comprising:

a plurality of food items in packaging having a cavity for containing the plurality of food items;

wherein the packaging comprises a sheet of packaging material that continuously wraps around and defines the cavity and which is sealed at a first end of the cavity by a first end seal, at a second opposed end of the cavity by a second end seal, and along the cavity by a longitudinal fin seal, the longitudinal fin seal extending from the first end seal to the second end seal;

wherein the first end seal and the second end seal are each permanent seals free from pressure sensitive adhesive;

wherein the longitudinal fin seal is an openable and recloseable seal joining an inside face of a first side edge of the sheet to an inside face of a second side edge of the sheet;

wherein the longitudinal fin seal is cold-sealed with a pressure sensitive adhesive printed on both inside faces;

wherein the packaging comprises a plurality of opening tab elements along the longitudinal fin seal, the plurality of opening tab elements being arranged to be gripped by a user to aid opening of the longitudinal fin seal; and wherein the plurality of food items are stacked in the packaging.

2. The packaged food product according to claim 1, wherein the sheet of packaging material is a monolayer or multilayer plastic film.

3. The packaged food product according to claim 1, wherein the first end seal and the second end seal and the longitudinal fin seal are the only seals that close the cavity.

4. The packaged food product according to claim 1, wherein the first end seal and the second end seal are free from adhesive.

5. The packaged food product according to claim 4, wherein the first end seal and the second end seal are each permanent welded seals.

6. The packaged food product according to claim 1, wherein the longitudinal fin seal comprises:

a first sealing zone positioned at or adjacent the first side edge and the second side edge of the sheet of packaging material; and a second sealing zone positioned adjacent the cavity, wherein the first sealing zone is spaced apart from the second sealing zone.

7. The packaging food product of claim 1, wherein the longitudinal fin seal comprises:

a sealing zone extending along the packaging from the first end seal to the second end seal adjacent first side edge and the second side edge of the sheet of packaging material;

wherein the sealing zone is shaped to define the plurality of opening tab elements;

wherein the sealing zone has a an outer edge profile having a different shape to that of the first side edge and the second side edge of the sheet, thereby providing a first opening tab element on the first side edge of the sheet and a corresponding second opening tab element on the second side edge of the sheet; and wherein the first side edge and the second side edge of the sheet have matching and aligned edge profiles.

8. The packaged food product according to claim 1, wherein the longitudinal fin seal comprises a sealing zone extending along the packaging from the first end seal to the second end seal and spaced apart from a side edge of the sheet of packaging material to provide a first opening tab element.

9. The packaged food product according to claim 8, wherein:

the side edge is the first side edge; and the sealing zone is spaced apart from the first side edge and spaced apart from the second side edge of the sheet of packaging material to provide the first opening tab element and a second opening tab element, respectively.

10. The packaged food product according to claim 1, wherein:

the longitudinal fin seal comprises a sealing zone extending along the packaging from the first end seal to the second end seal adjacent the first side edge and the second side edge of the sheet of packaging material;

the first side edge and the second side edge are straight-cut; and the sealing zone has an outer edge profile having a different shape to that of the first side edge and the second side edge of the sheet, thereby providing a first opening tab element on the first side edge of the sheet and a corresponding second opening tab element on the second side edge of the sheet.

11. The packaged food product of claim 1, wherein the plurality of food items are baked confectionery items.

12. The packaged food product of claim 11, wherein the plurality of food items are at least one of biscuits and cookies.

13. The packaged food product according to claim 1, wherein:

a first food item is positioned at the first end of the packaging;

a second food item is positioned at the second end of the packaging; and a plurality of additional food items are positioned in a row extending from the first food item to the second food item.

14. A method of packaging food items, the method comprising the steps of:

placing food items to be wrapped on a sheet of packaging material;

folding the packaging material so that a surface of the sheet forms an inner surface and an opposed surface of the sheet forms an outer surface of the packaging;

permanently sealing a first end of the sheet to itself to form a first end seal free from pressure sensitive adhesive;

permanently sealing a second end of the sheet to itself to form a second end seal free from pressure sensitive adhesive; and forming a longitudinal fin seal along the packaging from the first end to the second end thereby joining a first side edge of the sheet to a second side edge of the sheet and defining a cavity containing the food items;

wherein the longitudinal fin seal is an openable and recloseable seal joining an inside face of the first side edge of the sheet to an inside face of the second side edge of the sheet;

wherein the longitudinal fin seal is cold sealed with a pressure sensitive adhesive printed on both inside faces;

wherein the longitudinal fin seal comprises a sealing zone extending along the packaging from the first end seal to the second end seal;

wherein the packaging comprises a plurality of opening tab elements along the longitudinal fin seal, the plurality of opening tab elements being arranged to be gripped by a user to aid opening of the longitudinal fin seal; and wherein the food items are stacked in the packaging.

15. The method of claim 14, wherein the method provides a packaged food product according to claim 1.

16. The method of claim 14, wherein the method of packaging food items comprises flow-wrap pack packaging the food items.

17. The method of claim 14, wherein the first end seal and the second end seal are heat-sealed.

18. The method of claim 17, wherein:

portions of the sheet joined together to form each of the first end seal and the second end seal are pressed together between heated jaws or rollers; and portions of the sheet joined together to form the longitudinal fin seal are pressed together between unheated jaws or rollers.

19. The method of claim 14, wherein:

the step of permanently sealing the first end of the sheet to itself to form the first end seal comprises welding the first end of the sheet to itself, and the step of permanently sealing the second end of the sheet to itself to form the second end seal comprises welding the second end of the sheet to itself.

20. The method of claim 19, wherein the welding is thermal welding or ultrasonic welding.

* * * * *